US005391117A

United States Patent [19]

Miller

[11] Patent Number: 5,391,117

[45] Date of Patent: Feb. 21, 1995

[54] BOWLING BALL

[76] Inventor: John R. Miller, 10808 NE. 9th St., Vancouver, Wash. 98664

[21] Appl. No.: 2,245

[22] Filed: Jan. 8, 1993

[51] Int. Cl.[6] ..... A63B 37/00

[52] U.S. Cl. ..... 473/128

[58] Field of Search ..... 33/509, 510; 473/127, 473/128, 129, 130

[56] References Cited

U.S. PATENT DOCUMENTS

| | | | |
|---|---|---|---|
| 950,838 | 3/1910 | Cavanagh | 473/128 |
| 2,396,228 | 3/1946 | Berg | 473/130 |
| 2,712,160 | 7/1955 | Sterczek | 473/130 X |
| 3,386,176 | 6/1968 | Lotta | 33/509 |

*Primary Examiner*—George J. Marlo
*Attorney, Agent, or Firm*—Robert M. Sperry

[57] ABSTRACT

A bowling ball having at least one recess, and an insert generally filling said recess and formed of material molded about the fingers of the user of the ball to provide finger holes formed in said insert corresponding precisely to the size, spacing and curvature of the fingers of the user of the ball. A cap drilled to match the alignment of the customized finger holes is glued to the top of the insert to match the outer surface of the bowling ball.

8 Claims, 2 Drawing Sheets

BOWLING BALL

BACKGROUND

1. Field of Invention

This invention relates to bowling equipment and is particularly directed to improved bowling balls and methods of manufacturing said balls.

2. Prior Art

The sport of bowling has been popular for hundreds of years and there are numerous variations of the sport. One of the most popular versions is the game of Ten Pins, which employs a ball weighing approximately 10–16 pounds. These bowling balls are usually provided with holes, into which one or more of the bowler's fingers are inserted, to facilitate the bowler's grip on the ball and to assist in controlling or steering the ball. Two- or three-holed bowling balls are the most common. With two-hole bowling balls, the holes are positioned to accommodate the bowler's middle and third fingers, while three-hole balls provide an additional hole for the bowler's thumb. Obviously, the size, location and spacing of such holes must be varied to correspond to the size of the bowler's fingers, the span of the bowler's hand and the bowler's individual bowling style. Serious bowlers are often extremely critical of these matters and demand that their bowling balls be custom-made to provide the desired grip and control. Traditionally, bowling balls haven been made of molded rubber or plastic and the finger holes have been drilled into the balls, subsequently, by the retailer. The finger holes are usually straight and are drilled generally perpendicularly to the surface of ball to extend radially inward. However, when gripping, human fingers tend to curve and many prior art methods and apparatus have been proposed to accommodate such curvature in forming the holes of bowling balls. It has been proposed to drill relatively large diameter holes in a bowling ball and to provide customized inserts which could be formed to correspond to the size, shape and desired curvature of a given individual. However, this technique often adversely effects the weight and balance of the bowling ball and these factors are frequently irregular from one ball to the next. Furthermore, the prior art methods and apparatus for customizing bowling ball finger holes often add considerable expense to the cost of the bowling ball and sometimes require frequent maintenance. A search in the United States Patent Office has revealed the following:

| U.S. Pat. No. | INVENTOR | ISSUED |
|---|---|---|
| 5,002,277 | P. G. Ontko | Mar. 26, 1991 |
| 4,632,396 | W. G. Taylor | Dec. 30, 1986 |
| 2,703,712 | R. C. Obenchain | Mar. 8, 1955 |
| 3,401,935 | R. R. Dietz | Sept. 17, 1968 |

However, each of these references is subject to the limitations discussed above. Thus none of the prior art bowling balls and production methods have been entirely satisfactory.

BRIEF SUMMARY AND OBJECTS OF INVENTION

These disadvantages of prior art bowling balls and methods of producing them are overcome with the present invention and an improved bowling ball and production method are provided which permit the production of bowling balls having uniform weight and balance, yet which permit formation of finger holes having highly personalized characteristics, such as size, spacing and curvature, while adding little, if anything, to the cost of the bowling ball and requiring no additional maintenance.

The advantages of the present invention are preferably attained by providing a bowling ball having a generally wedge-shaped recess formed therein, forming an individual mold about the user's fingers, and forming a wedge member from said mold which is mountable in the recess of the bowling ball.

Accordingly, it is an object of the present invention to provide an improved bowling ball.

Another object of the present invention is to provide an improved bowling ball having highly individualized finger holes.

An additional object of the present invention is to provide an improved bowling ball having highly individualized finger holes, yet having uniform weight and balance.

An additional object of the present invention is to provide an improved bowling ball having highly individualized finger holes with uniform weight and balance at little or no additional cost.

A further object of the present invention is to provide an improved bowling ball having highly individualized finger holes with uniform weight and balance at little or no additional cost and requiring no additional maintenance.

A specific object of the present invention is to provide an improved bowling ball having a generally wedge-shaped recess formed therein, forming an individual mold about the user's fingers, and forming a wedge member from said mold which is mountable in the recess of the bowling ball.

Another object of the present invention is to provide an improved method of manufacturing bowling balls.

An additional object of the present invention is to provide an improved method of manufacturing bowling balls having highly individualized finger holes with uniform weight and balance at little or no additional cost and requiring no additional maintenance.

A specific object of the present invention is to provide a method of manufacturing a bowling ball comprising the steps of providing a bowling ball having a generally wedge-shaped recess formed therein, forming an individual mold about the user's fingers, and forming a wedge member from said mold which is mountable in the recess of the bowling ball.

These and other objects and features of the present invention will be apparent from the following detailed description, taken with reference to the figures of the accompanying drawing.

DETAILED DESCRIPTION OF THE INVENTION

Figure 1:
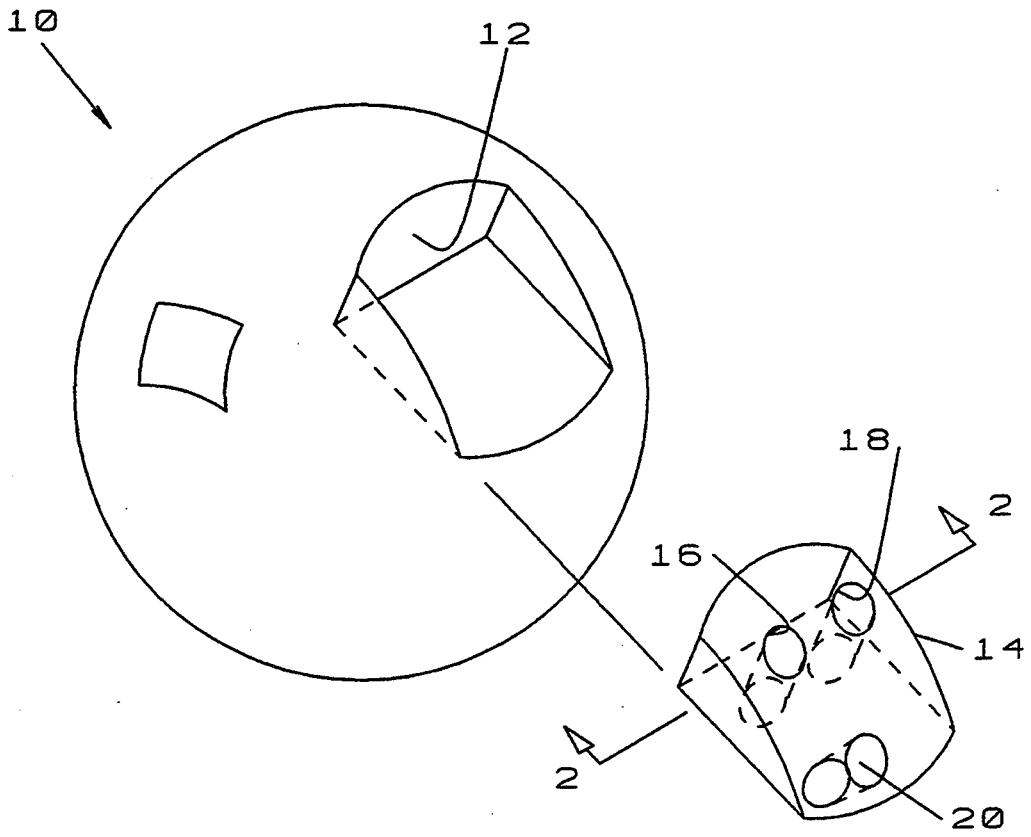
FIG. 1 is an exploded view of a bowling ball embodying the present invention.

In that form of the present invention chosen for purposes of illustration, FIG. 1 shows a bowling ball, indicated generally at 10, having a wedge-shaped recess 12 formed therein and having a removable member 14, shaped to mate with the recess 12 and having customized finger holes 16, 18 and 20 provided therein. The removable member 14 is composed of the same material as the bowling ball 10 and is individually formed to cause the finger holes 16, 18 and 20 to precisely fit the fingers of the purchaser of the bowling ball.

Figure 2:
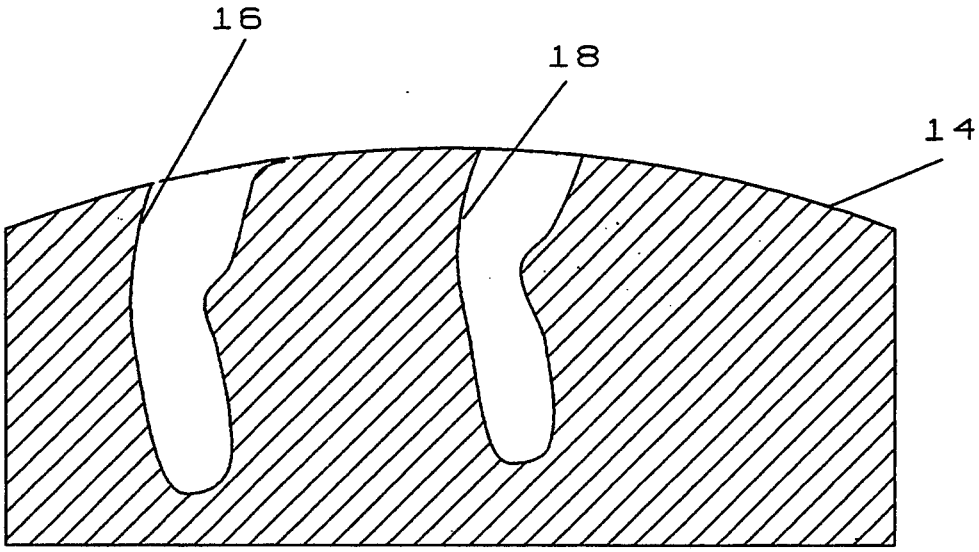
FIG. 2 is a vertical section through the bowling ball of FIG. 1 taken on the line 2—2 of FIG. 1.

In manufacturing the bowling ball 10, the bowling ball 10 is initially formed with the wedge-shaped recess 12. Subsequently, a tapered mold, not shown, is made to match the size of the recess 12 in the bowling ball 10. The mold is then filled with a mix of warm water and a suitable mold material, such as that available under the trademark "Pour Stone", from Custom Building Products, Inc. of Seal Beach, Calif., and is mixed to approximately the consistency of a milk shake. The bowler then puts on a plastic or rubber surgical-type glove and inserts his bowling fingers into the liquid Pour Stone anchoring cement in the mold. Next, he moves his fingers into the "ball gripping" position and holds them there approximately 6–8 minutes. At that point, the bowler flexes his fingers slightly several times to create a release pocket at the bottom of the cast and, after about 15 minutes, removes his fingers from the mold. This creates the wedge-shaped member 14 containing the customized finger holes 16, 18 and 20, as seen in FIGS. 1 and 2. The installer then cleans up and smooths out the finger mold while the material is still green. Next, the wedge-shaped member 14, containing the customized finger holes 16, 18 and 20, is inserted into the recess 12 of the bowling ball 10 and is fixedly secured therein. The wedge-shaped member 14 may be secured within the recess 12 by removable means, such as screws, not shown, or the recess 12 may be coated with a suitable adhesive, prior to insertion of the wedge-shaped member 14, to fixedly secure the wedge-shaped member 14 to the bowling ball 10. Finally, a cap 15, made of the bowling ball material, is cut to size, drilled to match the alignment of the customized finger holes 16, 18 and 20 and is glued to the top of the wedge-shaped member 14 to match the surface of the bowling ball 10. The open spaces between the cap and the wedge-shaped member 14 are filled with liquid plastic or Pour Stone anchoring cement. Since the wedge-shaped member 14 is formed to mate with the recess 12 of the bowling ball 10, and since the wedge-shaped member 14 is formed of material of equal weight to the material of the bowling ball 10, it will be apparent that, once the wedge-shaped member 14 has been secured within the recess 12, the weight and balance of the bowling ball 10 will be identical to that of an integrally formed bowling ball. However, since the finger holes 16, 18 and 20 have been customized to correspond precisely to the size, spacing and curvature of the bowler's fingers, the bowler will obtain optimum grip and control with the bowling ball 10.

As an alternative version of the method of the present invention, the step of forming the wedge-shaped member 14 could be omitted. Thus, the Plaster of Paris mold and the metal die, corresponding to the bowler's fingers, could be made, as described above. Thereafter, the die could be assembled into a mold for an integral bowling ball.

Figure 3:
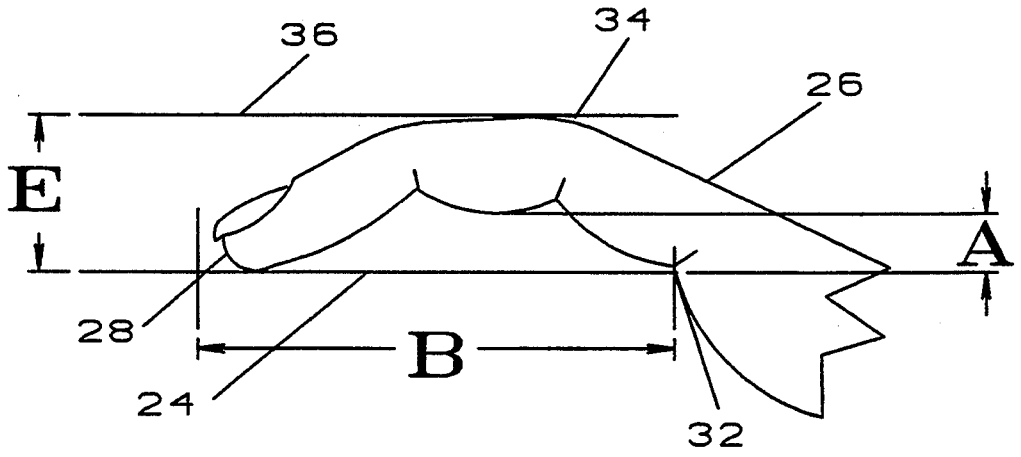
FIG. 3 is a diagrammatic representation showing how to make the measurements for forming an alternative form of the bowling ball insert of FIG. 1.
Figure 4:
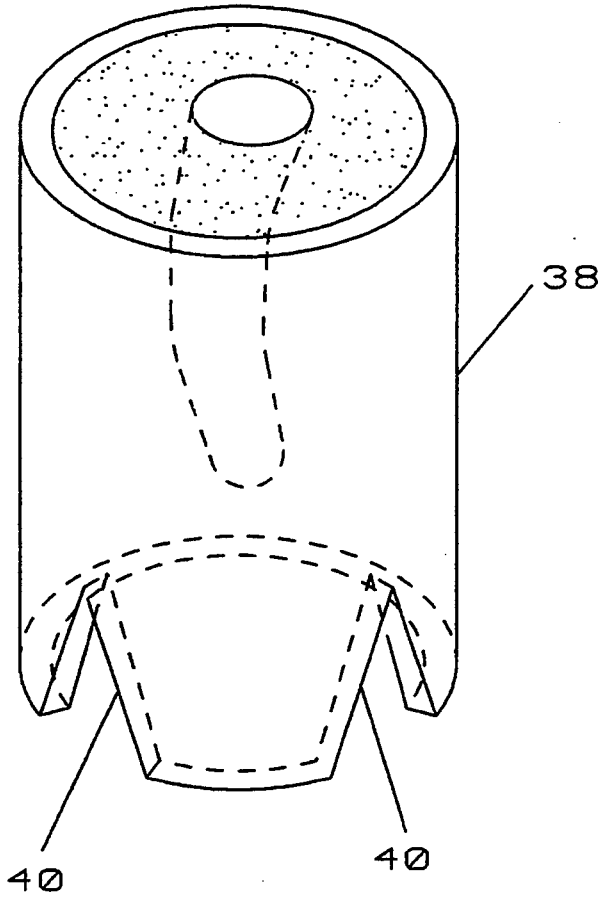
FIG. 4 is an isometric view of a set of bowling ball inserts embodying the alternate form of the bowling ball insert of FIG. 1.

FIG. 3 shows another alternative version of the method of the present invention in which individual inserts are made for the respective fingers, as seen at 38 in FIG. 4, and holes may be drilled into a bowling ball, not shown, to allow the inserts 38 to be placed in the holes and bonded to the bowling ball by suitable adhesives. To form the individual finger inserts 38, a straight line is drawn on a sheet of paper, as indicated at 24 FIG. 3. The paper is then placed on the edge of a table or the like and the bowler places his finger 26 on the paper with the finger bent in the desired configuration and with the tip 28 of the finger 26 touching the line 24, adjacent one end 30 of the line 24, and with the bottom of the third knuckle 32 also touching the line 24, as at point 32. The distance "A" between the line 24 and the bottom of the second knuckle is then measured and is preferably less than about 5/16 inch. Thereafter, the outline of the finger 26 is drawn on the paper and a mark is made at point 34, at the top of the second knuckle. A line 36 is then drawn through point 34 parallel to line 24 and measurements are made of distance "B", between point 32 and the tip 28 of the finger 26, and distance "E", between lines 24 and 36. A casing is made from a length of cylindrical rigid material, such as PVC pipe 38, having an inside diameter corresponding to distance "E" and is cut to a length approximately ½ inch longer than distance "B". A series of generally V-shaped cuts 40 are then made about the lower end of the pipe 38. Three such pipes 38 are made, corresponding respectively to the measurements of the bowler's second and third fingers and his thumb. Add one layer of fast setting specialist plaster bandage, available from Johnson & Johnson, to the inside top part of the pipe mold 38, being careful not to cover the V-shaped slots 40 in the bottom of the mold 38. Wet the plaster bandage inside the pipe mold 38 with warm water and let it set up. This will strengthen the cast. Measure enough Pour Stone anchoring cement to fill the two longest finger pipe molds, add warm water and mix to the consistency of a milk shake. Stand the PVC pipe finger molds 38 on a table, after taping the outside of the V-shaped slots 40 with masking tape, and pour the Pour Stone mixture to fill the PVC pipe finger molds 38. Have the bowler put a surgical glove on his bowling hand and immerse the second and third fingers into the finger pipe molds 38 in a gentle circular motion to remove air bubbles. Insert both fingers into the Pour Stone mixture in the molds 38 to the center of the second knuckle line and bend the fingers to their "ball gripping" positions within the molds 38. Hold the molds 38 vertical and have the bowler retain the desired finger position for about 6–8 minutes until the Pour Stone cement starts to set up. Then, have the bowler flex his fingers slightly a few times to create a release pocket at the bottom of the molds 38. The installer will then take some of the Pour Stone cement that has spilled out of the molds 38 and will fill and smooth out the top of the finger cast as the material sets up. After 15 minutes, have the bowler gently remove his fingers from the mold 38. The installer then cleans up and smooths out the mold inside, while the Pour Stone cement is still green. Thereafter, the bowler tries on the molds 38 a few times to slightly open the release points. Repeat this procedure to form the thumb mold. Holes slightly larger than the diameters of the pipe molds 38 are then drilled into the bowling ball 10 at the appropriate angles and all three pipe molds 38 are inserted into the holes in the ball 10. The bowler then inserts his fingers into the molds 38, in the ball 10, and moves the molds into the most comfortable position, while the installer marks the locations of these positions on the molds 38 and on the surface of the bowling ball 10. Next, remove the molds 38 from the bowler's fingers, apply glue to the interiors of the holes in the bowling ball 10 and reinsert the molds 38 into the holes in the bowling ball, being careful to line up the markings on the molds 38 with the markings on the surface of the bowling ball 10. Finally, take a small grinder and smooth out the surfaces of the ball and molds 38.

Obviously, numerous other variations and modifications could also be made without departing from the spirit of the present invention. Therefore, it should be clearly understood that the forms of the present invention described above and shown in the figures of the accompanying drawing are illustrative only and are not intended to limit the scope of the present invention.

What is claimed is:

1. A bowling ball comprising:

a ball in the shape of a sphere having at least one recess, and an insert generally filling said recess and formed of a material molded about at least one finger of the user of the ball to provide at least one finger hole formed in said insert corresponding precisely to the size, and curvature of at least one of the fingers of the user of the ball.

2. The bowling ball of claim 1 wherein:

said insert comprises a sleeve formed of rigid material and filled with moldable material.

3. The bowling ball of claim 1 wherein:

said insert is formed of the same material as said ball.

4. The bowling ball of claim 1 wherein:

said insert is releasably mounted in said recess.

5. The bowling ball of claim 1 wherein:

said insert is fixedly mounted in said recess.

6. The bowling ball of claim 1 wherein:

said insert contains a plurality of finger holes corresponding precisely to the size, spacing and curvature of the fingers of the user of the ball.

7. The bowling ball of claim 1 wherein:

said insert contains a thumb hole corresponding precisely to the size, spacing and curvature of the thumb and at least one finger of the user of the ball and at least one finger hole.

8. The bowling ball of claim 1 wherein a cap covers said insert and corresponds in curvature to the spherical outer surface of the bowling ball.

* * * * *